US005641060A

United States Patent [19]

Tracey

[11] Patent Number: 5,641,060

[45] Date of Patent: Jun. 24, 1997

[54] ACTUATOR MECHANISM FOR A CONTROLLED DEVICE, AND SWITCHING MEANS OPERATED BY THE MECHANISM

[75] Inventor: Peter Martin Tracey, Bury St. Edmunds, United Kingdom

[73] Assignee: Bestquint Limited, Bury St. Edmunds, United Kingdom

[21] Appl. No.: 496,444

[22] Filed: Jun. 29, 1995

[30] Foreign Application Priority Data

Jun. 30, 1994 [GB] United Kingdom ..... 9413188

[51] Int. Cl.[6] ..... H01H 13/58

[52] U.S. Cl. ..... 200/526; 200/523; 200/529

[58] Field of Search ..... 200/523, 524, 200/526, 528, 525, 520

[56] References Cited

U.S. PATENT DOCUMENTS

| | | | |
|---|---|---|---|
| 3,790,734 | 2/1974 | Raab et al. . | |
| 3,852,546 | 12/1974 | Maxwell, Jr. et al. . | |
| 3,867,591 | 2/1975 | Nordeen | 200/332 |
| 4,317,015 | 2/1982 | Buttner et al. | 200/526 |
| 4,319,106 | 3/1982 | Armitage | 200/526 |
| 4,762,969 | 8/1988 | Tracey . | |
| 5,132,499 | 7/1992 | Valenzona et al. | 200/526 |
| 5,178,265 | 1/1993 | Sepke . | |
| 5,493,089 | 2/1996 | Chasen et al. | 200/526 |

FOREIGN PATENT DOCUMENTS

| | | |
|---|---|---|
| 0003844 | 9/1979 | European Pat. Off. . |
| 1232434 | 10/1960 | France . |

*Primary Examiner*—David J. Walczak
*Attorney, Agent, or Firm*—Richard M. Goldberg

[57] ABSTRACT

An actuator converts an input movement to a control movement with a bistable action. The actuator is operable to provide a first control movement in response to a first input movement and a second control movement immediately upon the second input movement. The actuator is embodied in a foot switch and in an air switch.

19 Claims, 18 Drawing Sheets

ACTUATOR MECHANISM FOR A CONTROLLED DEVICE, AND SWITCHING MEANS OPERATED BY THE MECHANISM

This invention relates to an actuator mechanism for converting an input movement to a control movement for supply to a controlled device.

Bistable actuator mechanisms for electrical switches and other control devices are known in which one forward movement from a normal or rest position changes the state of the switch, and a subsequent movement reverts the switch to its original state, the movements being capable of being carried out cyclically and indefinitely.

One such mechanism is disclosed in U.S. Pat. No. 4,762,969. This patent discloses an air-operated switch in which there is provided chamber means defining a variable volume chamber to receive pressure pulses from an actuator, the variable volume chamber having a movable wall; an electrical switch having an actuator element movable to change the state of the switch; and a mechanism for transmitting motion from the movable wall to the actuator element to change the state of the switch upon a first movement of the movable wall and to change back the state of the switch upon a repeat of the same movement of the movable wall. The switch is characterised in that the mechanism for transmitting motion from the movable wall to the actuator element comprises first and second axially movable elements and latch means operable to hold the elements in a first relative axial position after one movement of the movable wall and to release the elements after a subsequent movement of the movable wall. The sequence of operation of the air operated switch disclosed in the above patent is as follows:

1. Pressure is applied to the variable volume chamber, and the system is switched ON.

2. Pressure in the variable volume chamber is removed, and the switch latches ON.

3. Pressure is applied a second time to the variable volume chamber and the switch remains ON.

4. Pressure in the variable volume chamber is removed and the system switches OFF and resets.

It is an object of the invention to provide an improved switch which is more "operator friendly". The applicants have realised that the above mentioned air operated switch has the disadvantage that in the second part of its cycle the switch remains on until the pressure is released.

In one aspect the invention provides a pressure switch as aforesaid, wherein the latch means is operable to hold the elements in a first relative axial position after one movement of the movable wall and to release the elements during a subsequent movement of the movable wall. The subsequent movement may be a continuation of the first movement, or it may be a repeat of the first movement of the movable wall.

In a further aspect the invention provides an actuator mechanism for converting an input movement to a control movement for supply to a controlled device, said mechanism comprising first and second elements, means supporting said first and second elements for movement along a line of action, the first element being movable in translation along the line of action from a normal position in response to the input movement and being biased to return to said normal position, and the second element being movable in translation along the same line of movement to provide the control movement, wherein latch means operates cyclically to hold the elements in a first relative position at a greater spacing apart along the line of movement after one movement of the first element from its normal position and to release the elements for movement to a second relative axial position at a lesser spacing along the line of movement during a succeeding movement of the first element from its normal position, the arrangement being such that release of the elements for movement to the second relative axial position is enabled by the succeeding movement of the first element without requiring return of the first element to its normal position.

The collinear arrangement of the first and second elements enables embodiments of the invention to be constructed as compact units which have a closed housing. The actuator mechanism is therefore easy to make as a sub-assembly and to fit into the intended switch or other device which it is intended to control. This combination of properties is coupled with the characteristic that the movement of the second element of the second relative axial position can take place on forward movement of the first element without requiring a return movement.

In a further aspect the invention provides an actuator mechanism for converting an input movement to a control movement for supply to a controlled device, said mechanism comprising first and second elements, means supporting said first and second elements for relative movement, the first element being movable from a normal position in response to the input movement and being biased to return to said normal position and the second element being movable to provide the control movement, wherein latch means operates cyclically to hold the elements in a first relative position at a greater spacing apart after one movement of the first element from its normal position and to release the elements for movement to a second relative position at a lesser spacing after a succeeding movement of the first element from its normal position, wherein the relative position of the first and second elements is controlled by rotary latch or escapement means, the arrangement being such that release of the elements for movement to the second relative position is enabled by the succeeding movement of the first element without requiring return of the first element to its normal position.

Various preferred aspects of the invention are defined in the accompanying claims, to which attention is hereby directed.

There follows a description, by way of example, of specific embodiments of the present invention, reference being made to the accompanying drawings in which:

FIG. 1 is a diagrammatic perspective view of a foot operated switch assembly according to the invention which incorporates a latching member;

FIGS. 2(*a*) to 2(*d*) are simplified sectional views of a latching mechanism forming part of the switch assembly of FIG. 1;

Figure 1:
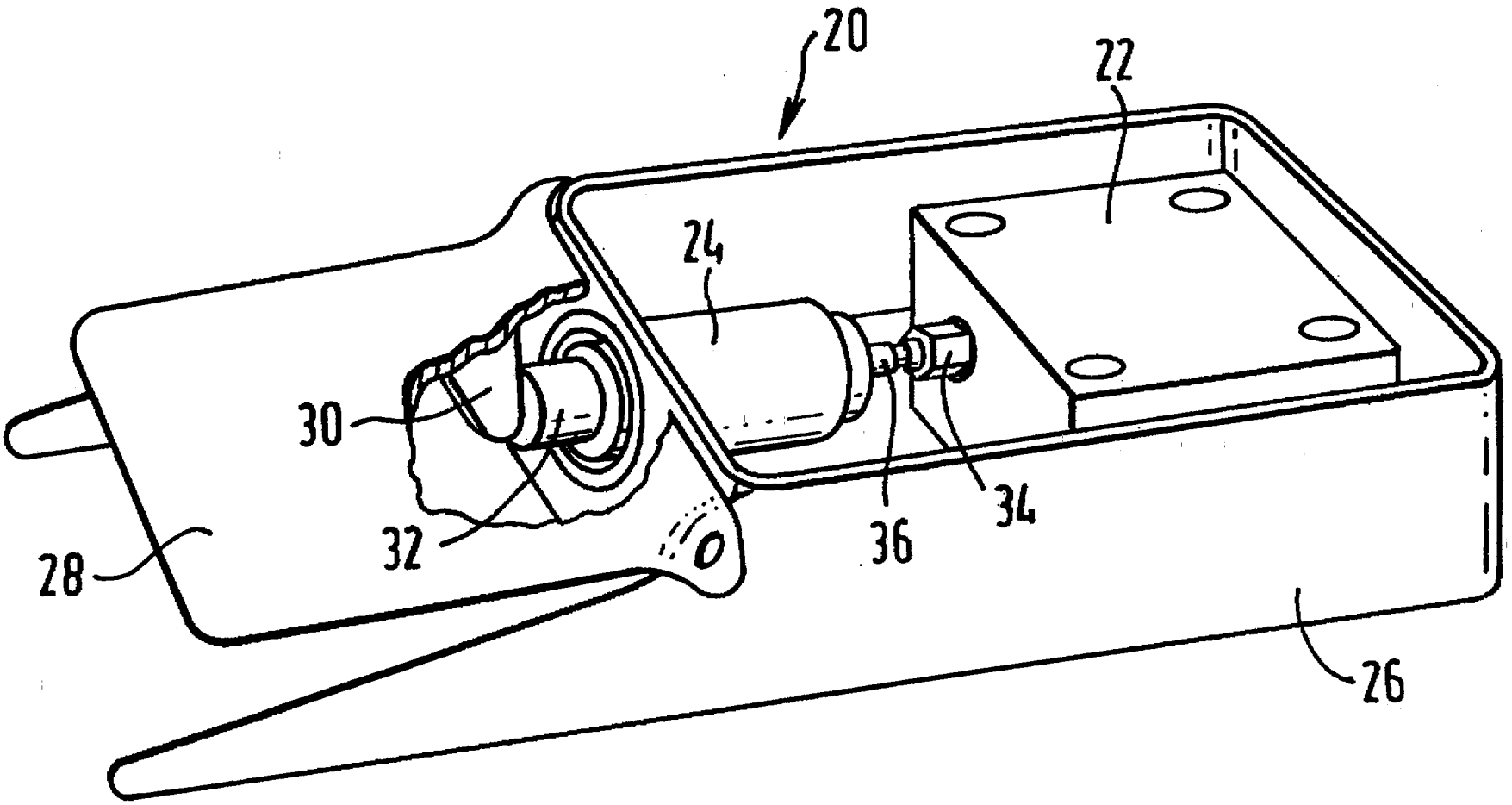
Figure 2A:
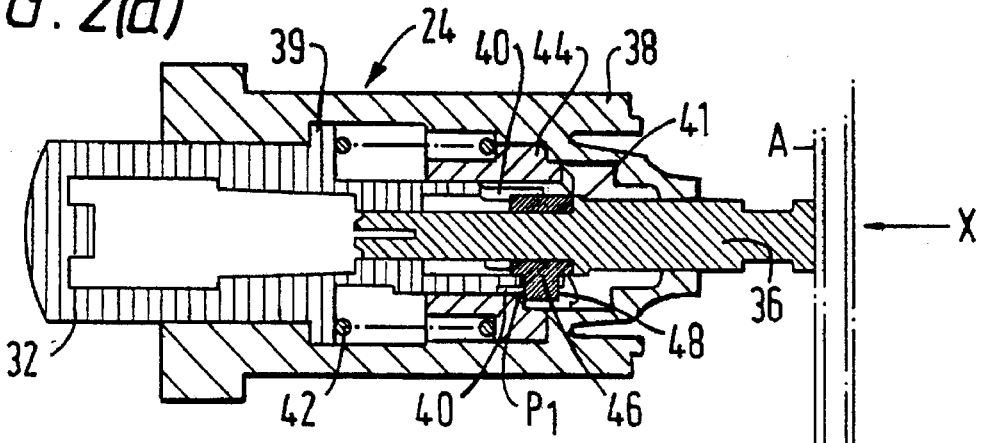
Figure 2B:
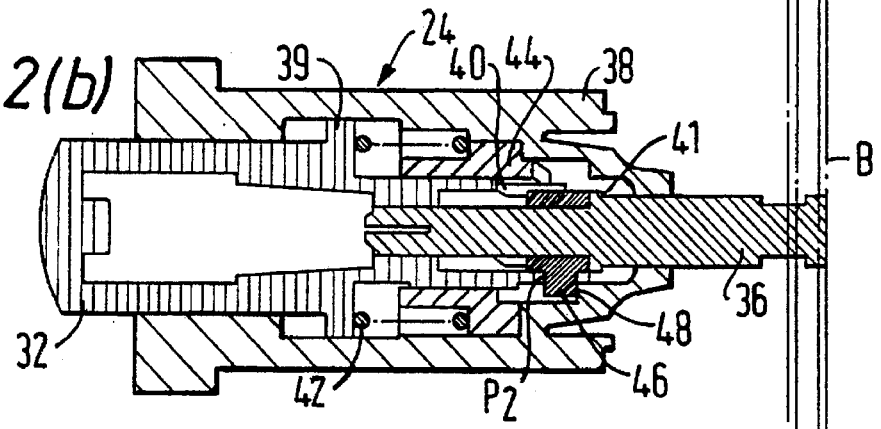
Figure 2C:
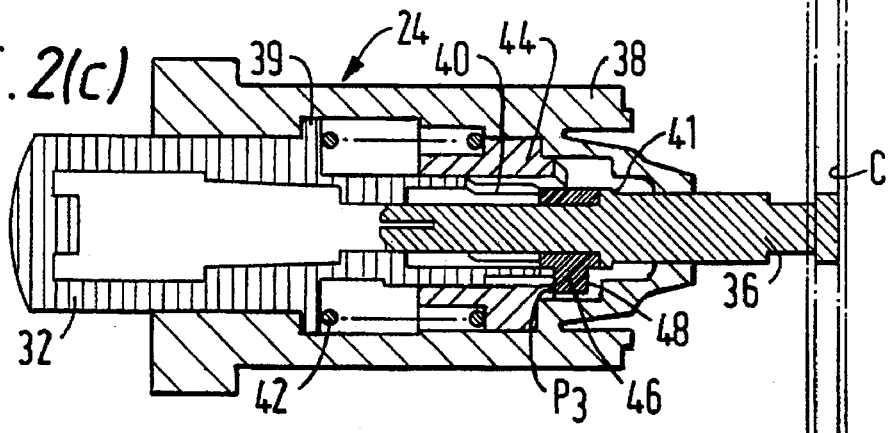
Figure 2D:
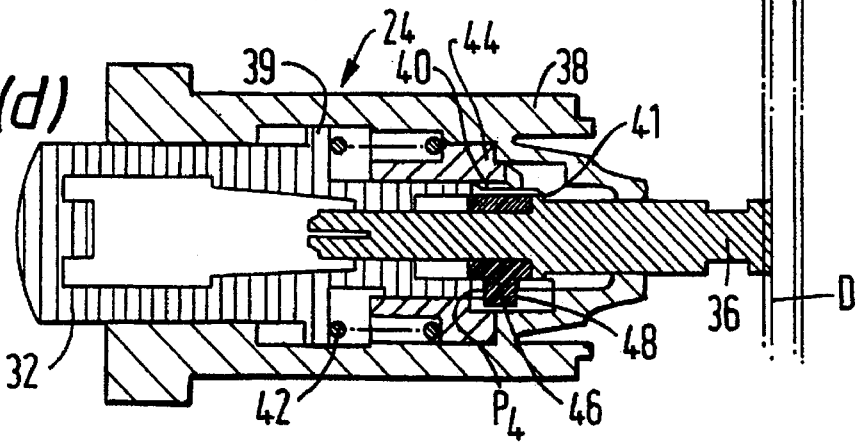
Figure 6A:
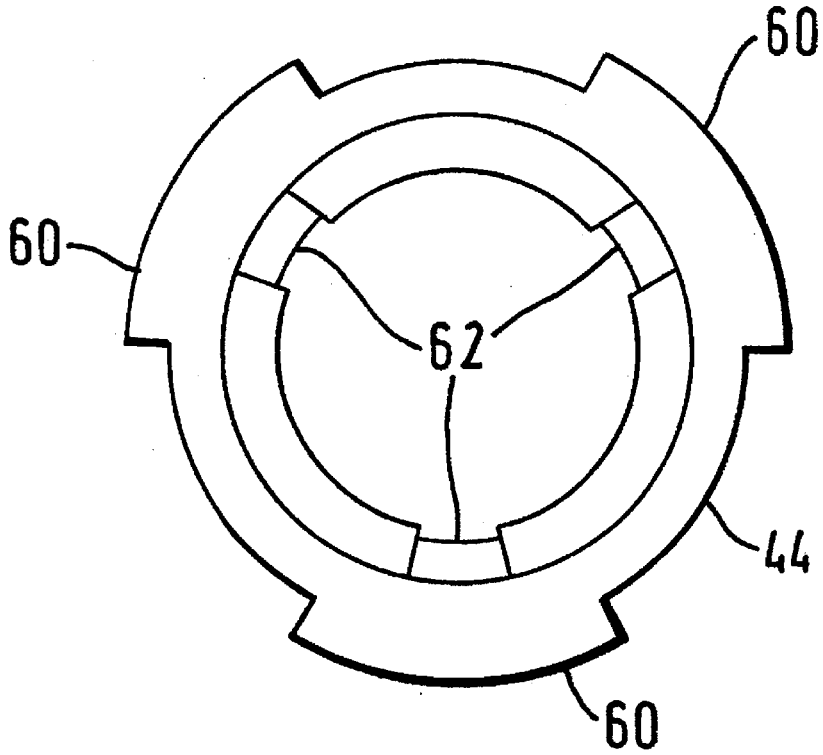
Figure 6B:
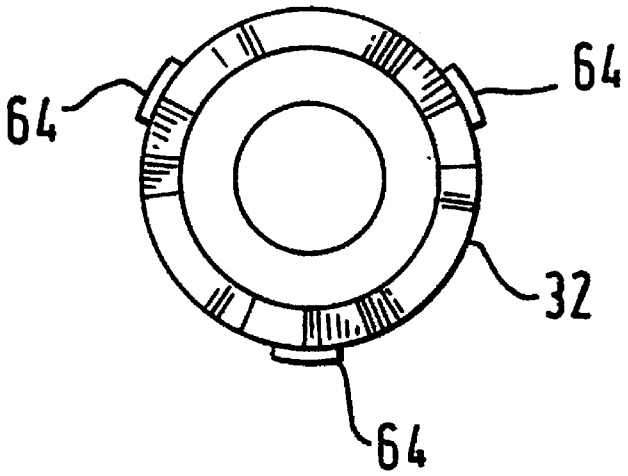
Figure 7A:
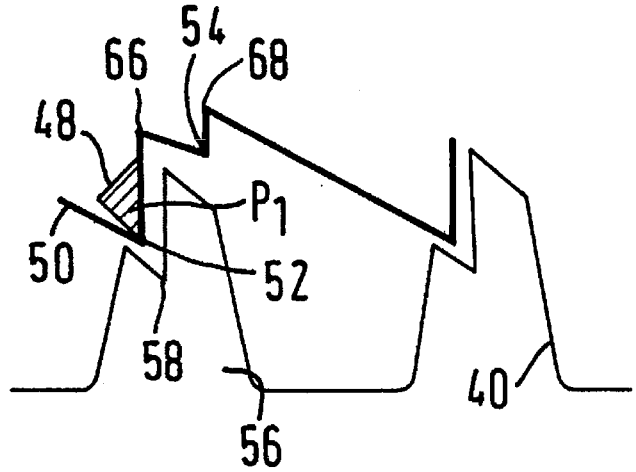
Figure 7B:
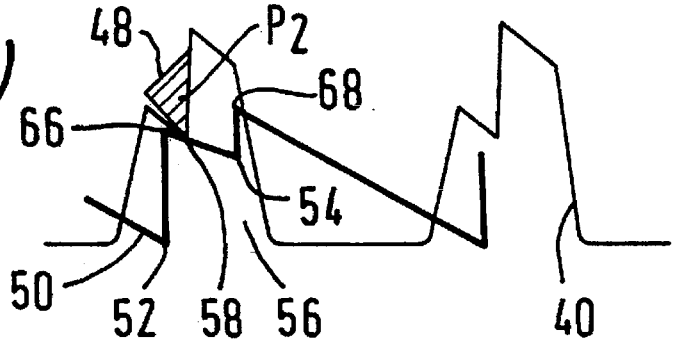
Figure 7C:
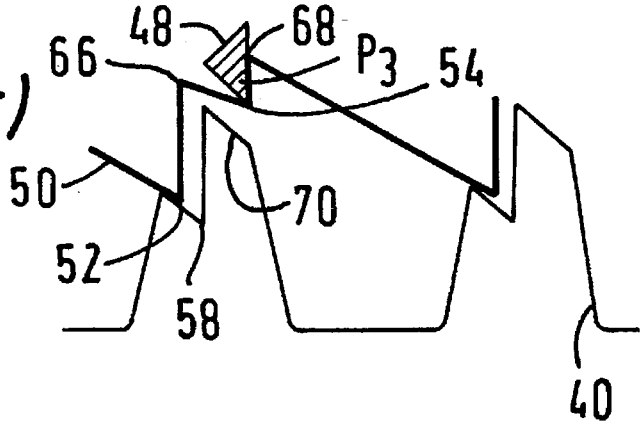
Figure 7D:
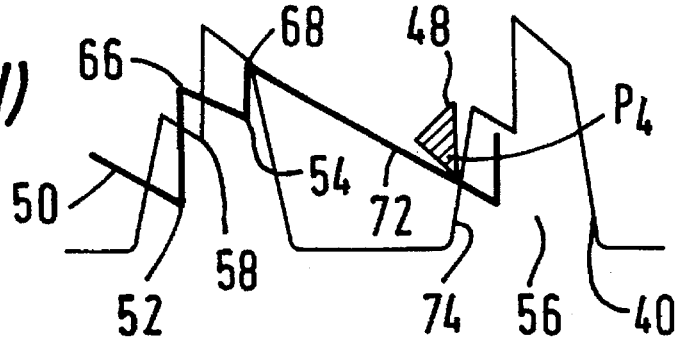
Figure 8A:
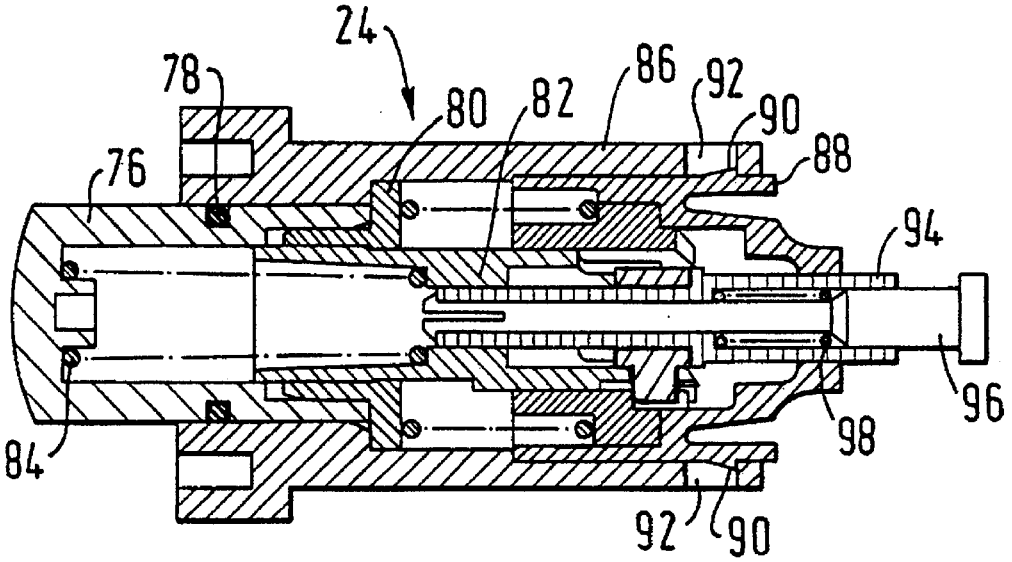
Figure 8B:
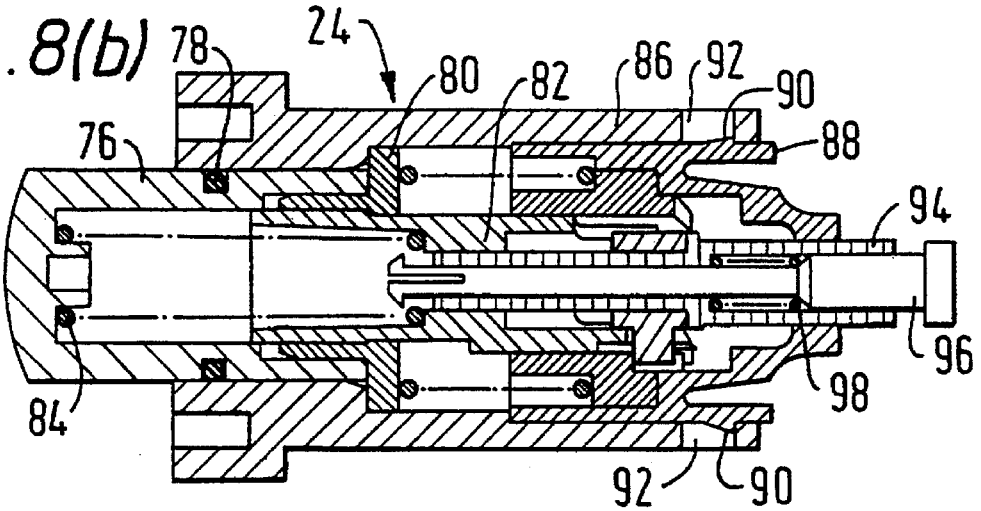
Figure 8C:
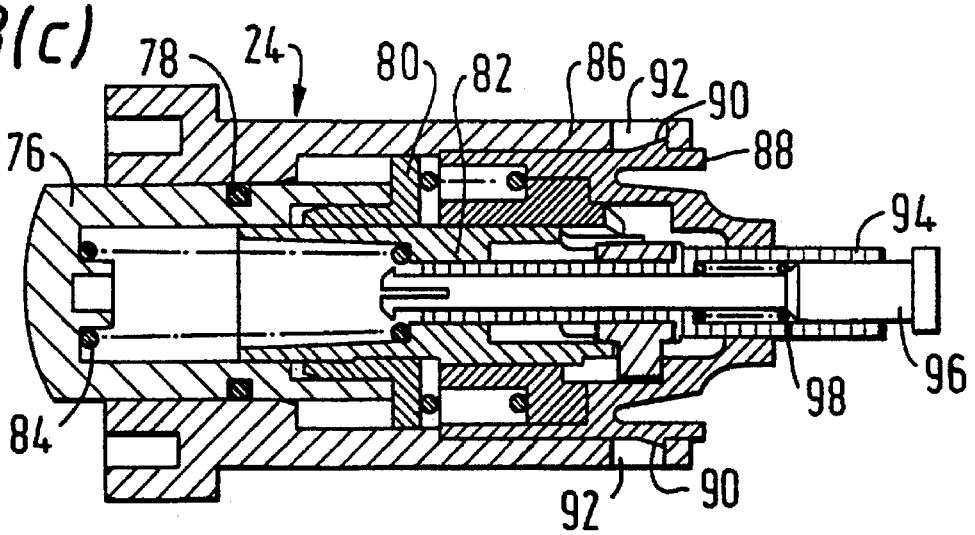
Figure 9:
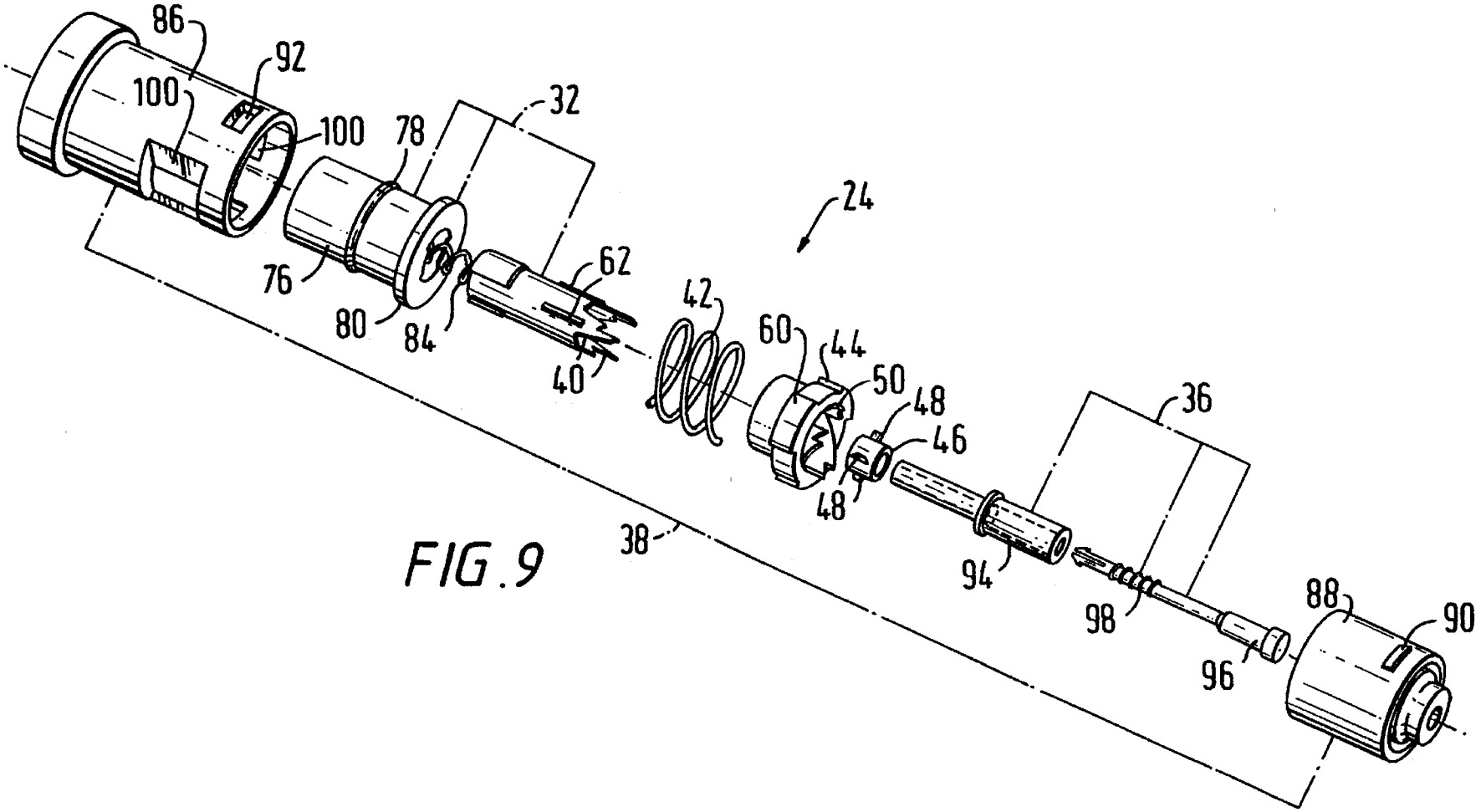
Figure 10:
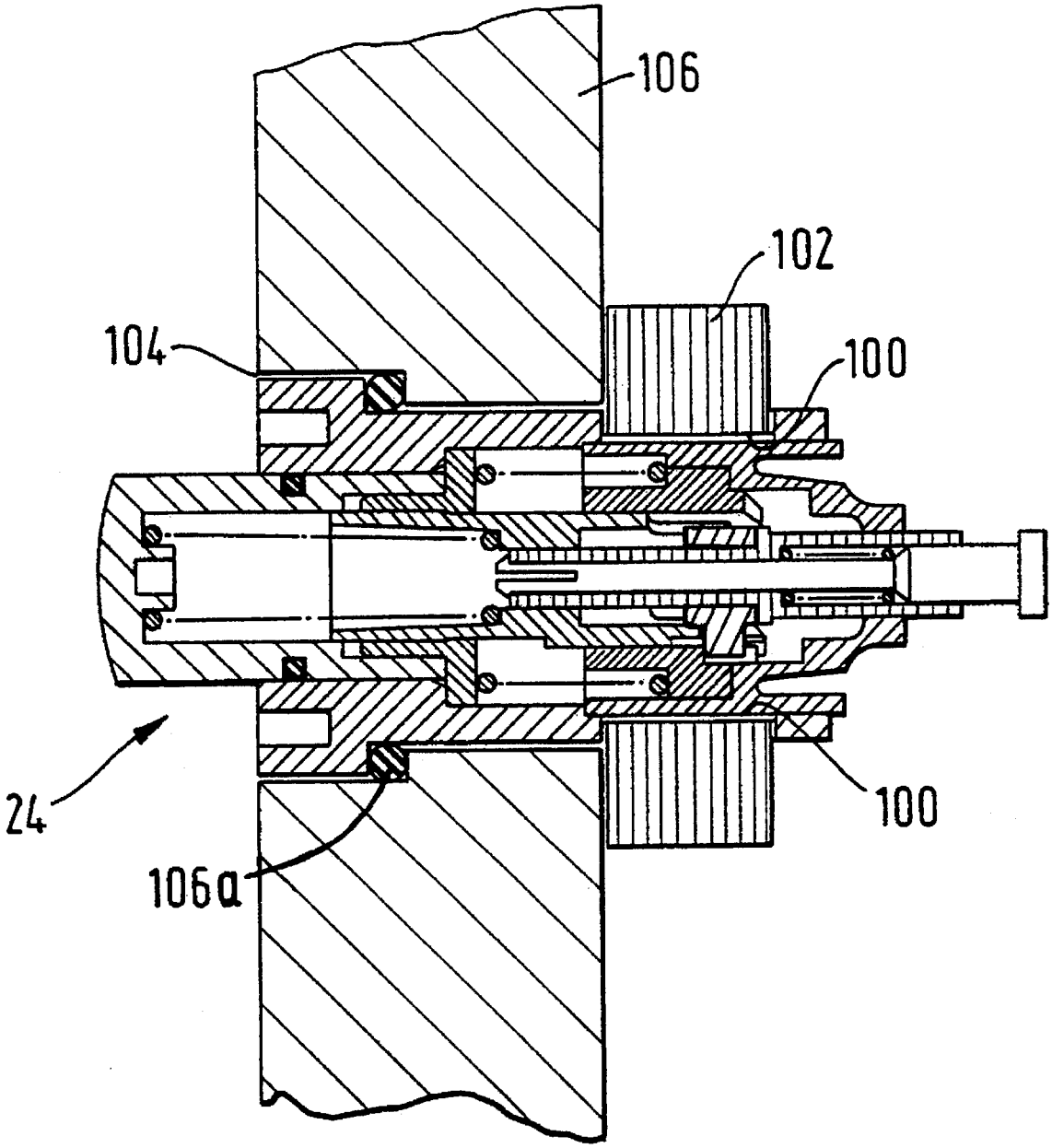
Figure 11:
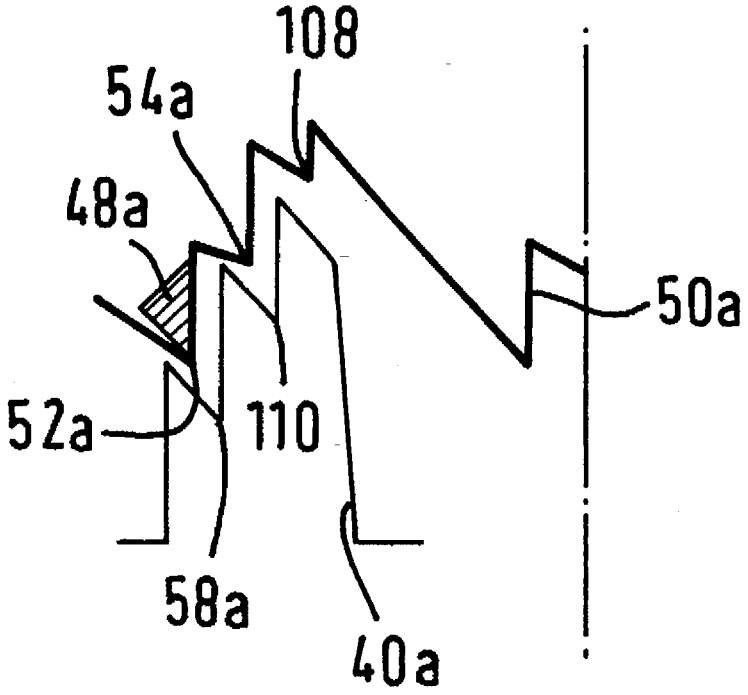
Figure 12A:
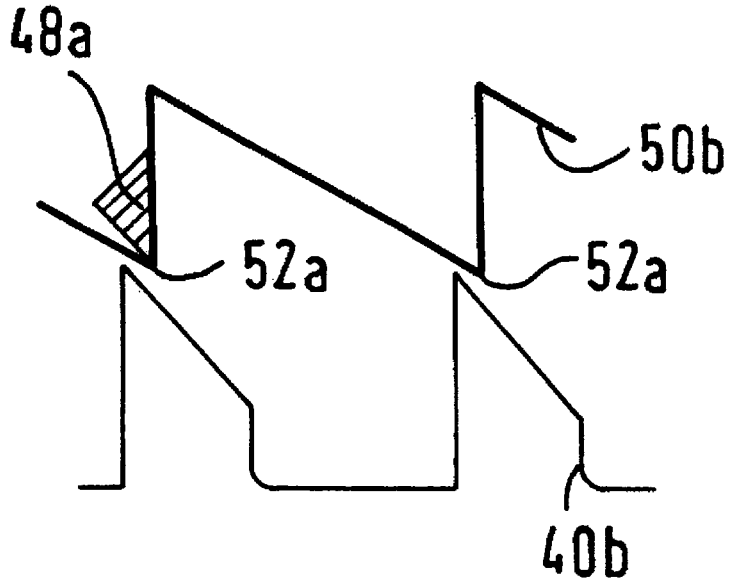
Figure 12B:
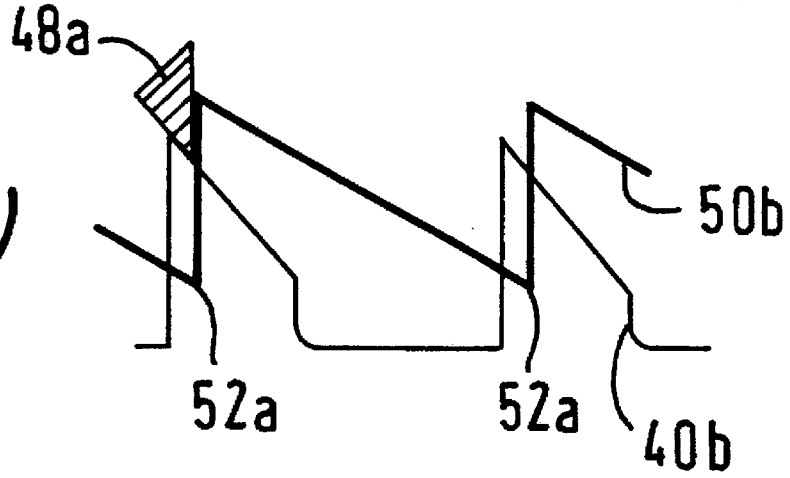
Figure 12C:
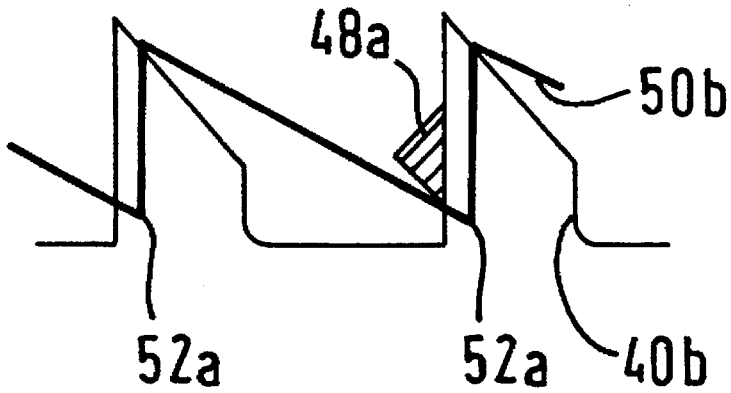
Figure 13A:
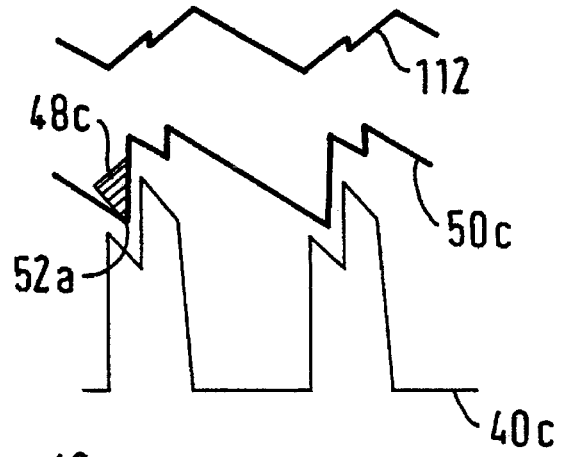
Figure 13B:
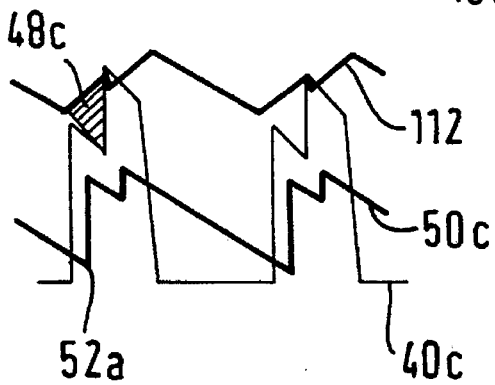
Figure 13C:
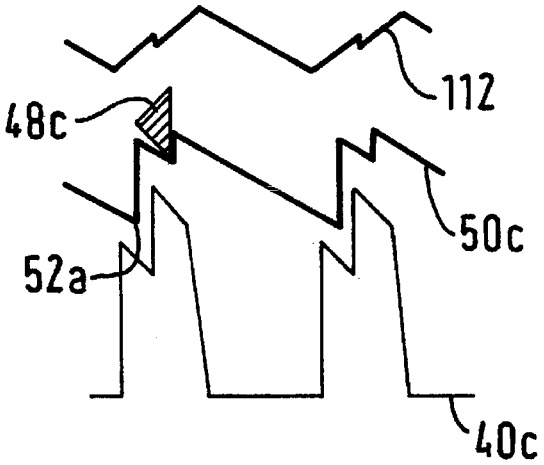
Figure 13D:
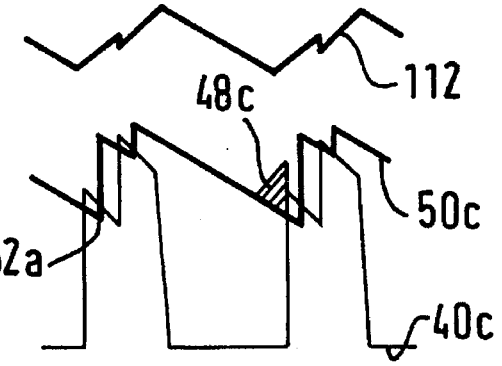
Figure 15:
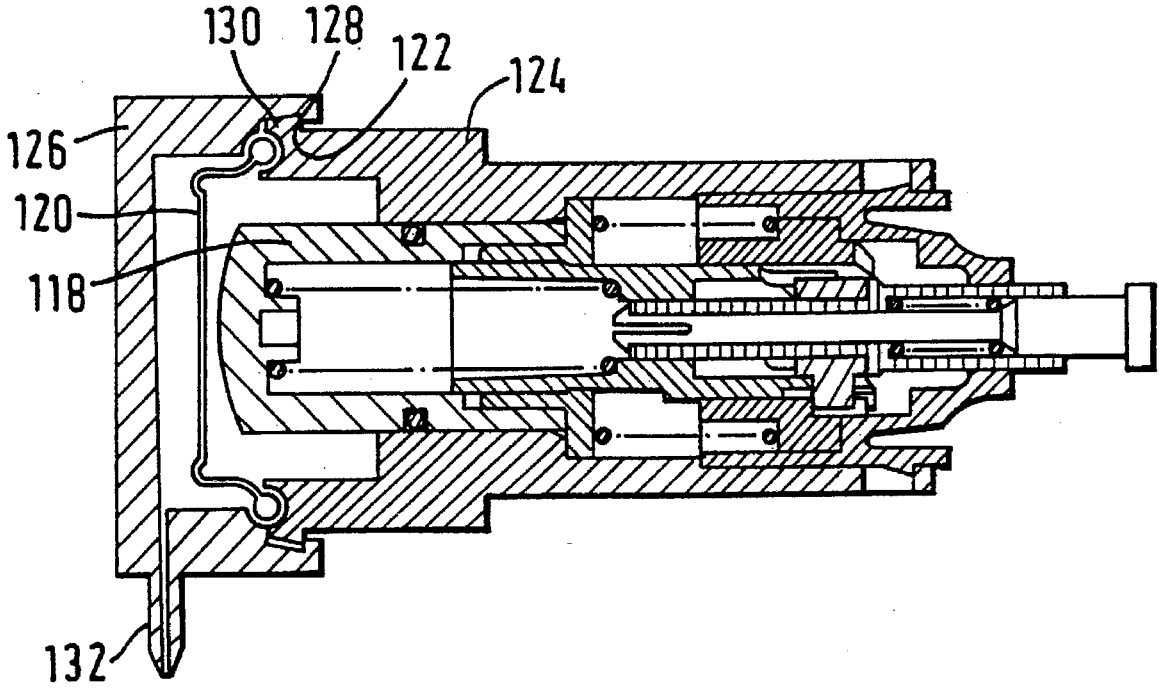

FIGS. 6 (*a*) and 6(*b*) are views of part of the latching mechanism looking in the direction X shown in FIG. 2(*a*);

FIGS. 7(*a*) to 7(*d*) are developments of part of the holding cam surface and the operating cam surface forming part of the latching mechanism of FIGS. 2(*a*) to 2(*d*) with the latching cam also being shown;

FIGS. 8(*a*) to 8(*c*) are more detailed views in different positions of a latching mechanism forming part of the foot switch assembly of FIG. 1;

FIG. 9 is an exploded view of the latching mechanism;

FIG. 10 is a view in longitudinal section of a latching element mounted in a wall or bulkhead;

FIG. 11 is a development of a holding cam surface and an operating cam surface according to a second embodiment of the latching mechanism;

FIGS. 12(*a*) to 12(*c*), 13(*a*) to 13(*d*), and 14(*a*) to 14(*e*), are developments of a holding cam surface and a latching cam surface according to third to fifth embodiments of the latching mechanism;

FIG. 15 is a view in a longitudinal section of a pressure chamber and latching mechanism according to a yet further embodiment of the invention.

Figure 16:
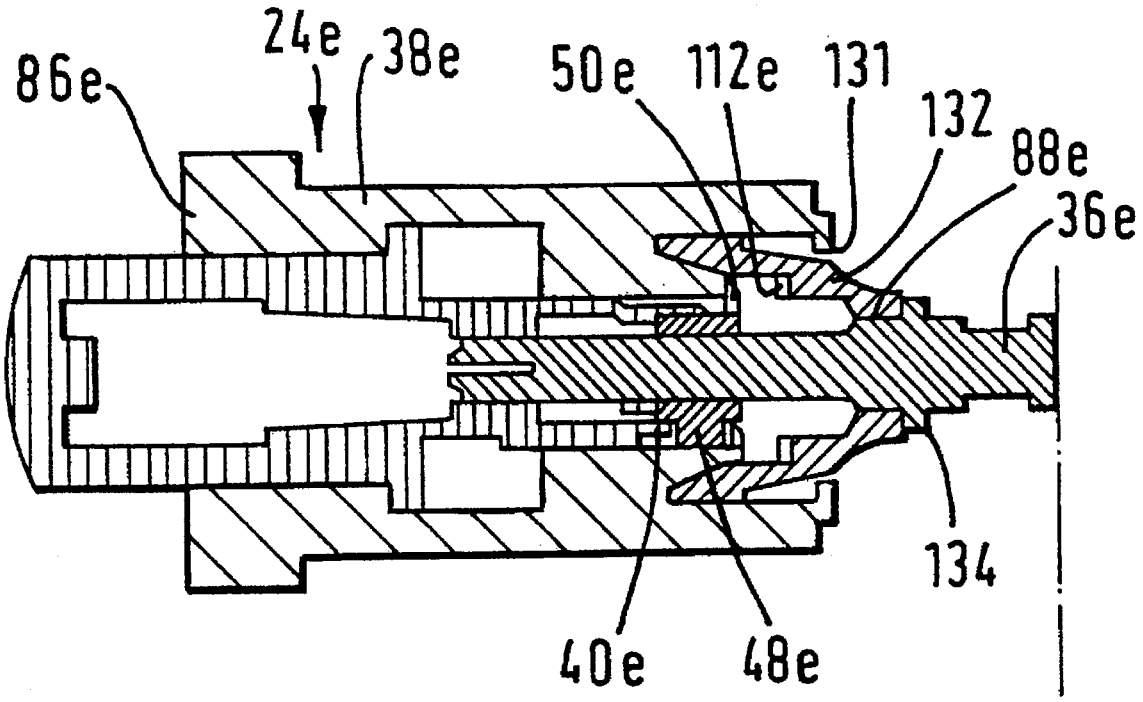
Figure 17A:
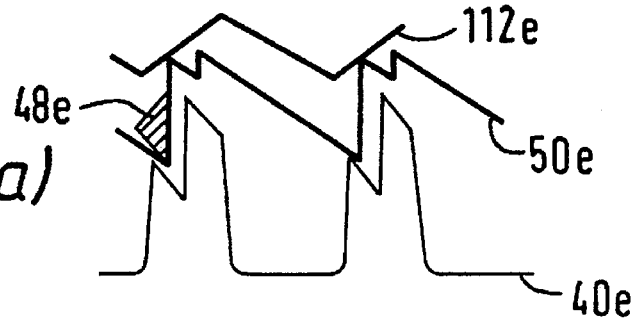
Figure 17B:
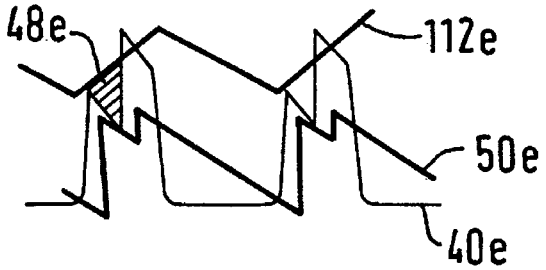
Figure 17C:
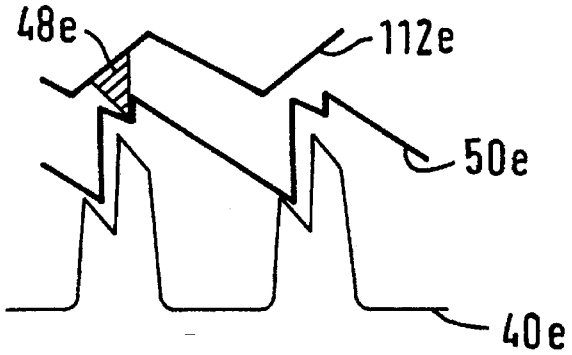
Figure 17D:
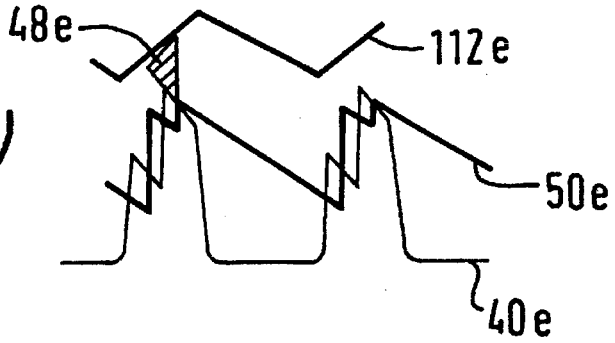
Figure 17E:
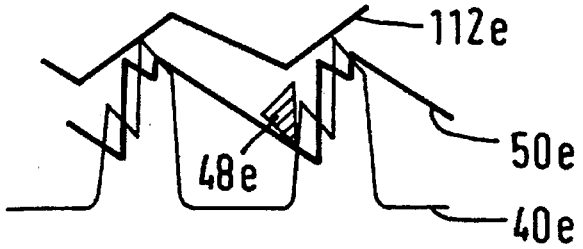
Figure 18A:
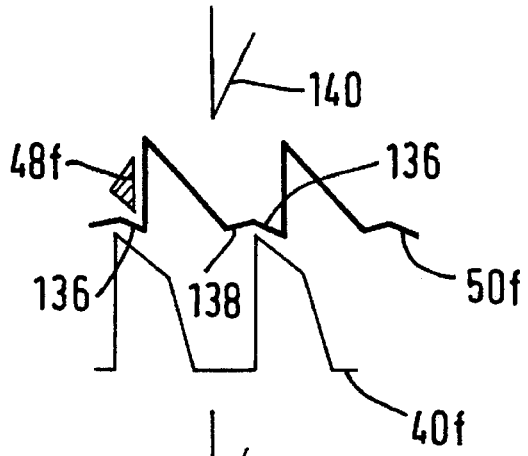
Figure 18B:
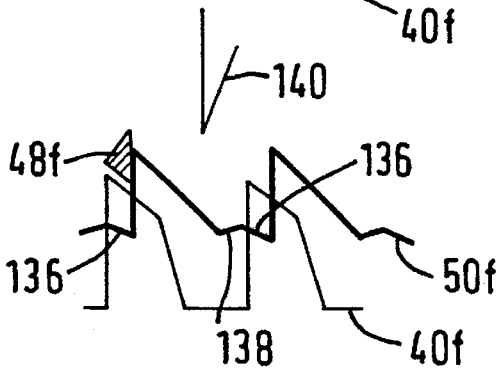
Figure 18C:
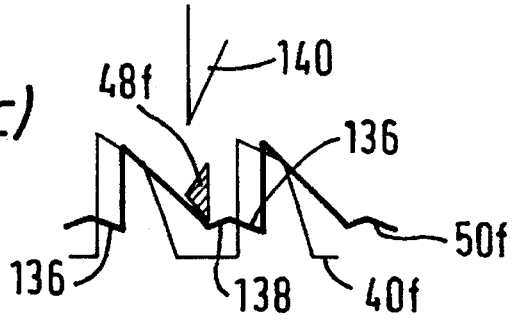
Figure 18D:
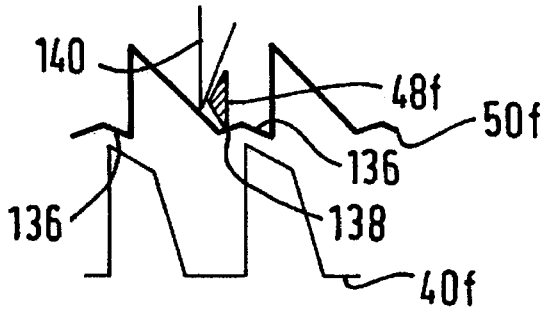
Figure 18E:
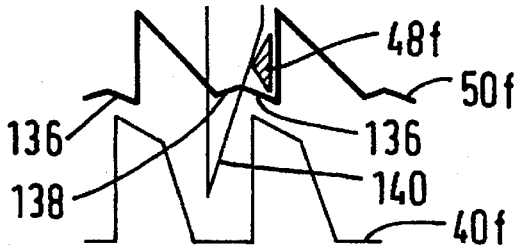

FIG. 16 is a simplified cross-section of a seventh embodiment of the latching mechanism;

FIGS. 17(*a*) to 17(*e*) are developments of the holding cam surface and latching cam surface in the seventh embodiment of the latching mechanism shown in FIG. 16; and FIGS. 18(*a*) to 18(*e*) show the cam surfaces of an eighth embodiment of the latching mechanism.

With reference to FIG. 1 a foot switch (20) comprises an electrical switch (22) and a latching mechanism (24) mounted within a body (26). The body (26) has pivoted thereon a pedal (28) which has a projection (30). The pedal (28), latching mechanism (24) and the electrical switch (22) are arranged so that when the pedal (28) is depressed the latching mechanism is operated by projection (30) and, in turn, the latching mechanism (24) operates to change the electrical switch (22) sequentially into its OFF or ON states. The latching mechanism (24) has an operating button (32) which is operated by the projection (30) as the pedal (28) is depressed and is biassed to maintain the pedal (28) in the non-depressed position. The electrical switch includes a button (34) which is biassed outwardly from the switch (22) in the direction of the latching mechanism (24) to substantially maintain the button (34) in contact with an actuating rod (36) of the latching mechanism (24).

The foot switch (20) has a bistable action, so that if the electrical switch (22) is in the OFF position when the pedal (28) is in its rest (raised) position then when the pedal (28) is depressed, the electrical switch (22) will be turned to the ON state. Conversely if the electrical switch (22) is ON when the pedal (28) is in its rest position, then depressing the pedal will cause the electrical switch to be turned OFF. This bistable function is provided by the latching mechanism (24) and will be described further with reference to FIGS. 2(*a*) to (*d*) which show the relative movements of the actuating rod (36) in response to successive movements of the operating button (32).

In FIGS. 2(*a*) to 2(*d*), the latching mechanism (24) comprises a generally cylindrical body (38) with the operating button (32) protruding from one end and the actuating rod (36) protruding from the other end. The button (32) is slidable axially within the body (38), is held captive therein by flange (39) and is biassed to an outward position relative to body (38) by spring (42). The operating button (32) has a series of operating cams (40), formed on its inward end which are described in detail below. Actuating rod (36) is slidably mounted within the body member (38) and is supported at its outward end by portions of the body member (38) and by portions of the operating button (32), within which it is a sliding fit, at its inward end. The actuating rod (36) is held captive within the body member (38) by flange (41). A latching member (46) is mounted rotatably on the actuating rod (36) inwardly of the flange (41) and includes latching cams (48) (see also FIG. 7).

FIG. 2(*a*) shows a nominal start position of the latching mechanism (24) in which the operating button (32) is in the outward position. The latching cams (48) are engaged with holding member (44), at a plane defined by the points P1 in an inward position relative to the body (38), resulting in the actuating rod (36) being held in an inward position A under the thrust of button (34). At this position, the electrical switch (22) is OFF.

When the latching mechanism (24) is in the position of FIG. 2(*a*) and the operating button (32) is pushed inwardly against the resistance of spring (42), then the latching mechanism (24) takes up the position shown in FIG. 2(*b*). The inward travel of the button (32) brings the operating cam surface (40) into engagement with the latching cams (48) at a plane defined by points P2 and the latching member (46) and the actuating rod (36) are held outwardly in position B, at which the electrical switch (22) is ON.

When the latching mechanism (24) is in the FIG. 2(*b*) position described and the operating button (32) is released, then the latching mechanism (24) will assume the position shown in FIG. 2(*c*). The operating button (32) has returned to its outward position by the action of spring (42) and the latching cams (48) are engaged with the holding member (44) at a plane defined by points P3, permitting the actuating rod (36) to move inwardly under the thrust of button (34) to position C, where the electrical switch (22) remains ON.

When the latching mechanism (24) is in the FIG. 2(*c*) position, and the operating button (32) is pressed inwardly, then the components of the latching mechanism (24) move to the positions shown in FIG. 2(*d*). The latching cams (48) have become disengaged with the holding member (44), but are engaged with the operating cam surface (40) in a plane defined by points P4 inward of the position shown in FIG. 2(*c*). The actuating rod (36) is at position D at which the electrical switch (22) has turned OFF.

When the latching mechanism (24) is in the FIG. 2(*d*) configuration and the operating button (32) is released, then the latching mechanism (24) resumes the state described for FIG. 2(*a*) above. The above sequence of states can be repeated an infinite number of times.

As outlined above, with reference to FIGS. 2(*a*) to (*d*) the bistable action of the latching mechanism is provided by the interaction of the holding member (44), latching cams (48) and operating cam surface (40). The stable states, when actuating rod is in positions shown in FIG. 2(*a*) and FIG. 2(*c*) are provided by the interaction of the latching cams (48) and the holding member (44) at points P1 and P3 respectively. The unstable states shown in FIG. 2(*b*) and FIG. 2(*d*) result from the interaction of the latching cams (48) and the operating cam surface (40) at points P2 and P4.

Figure 3B:
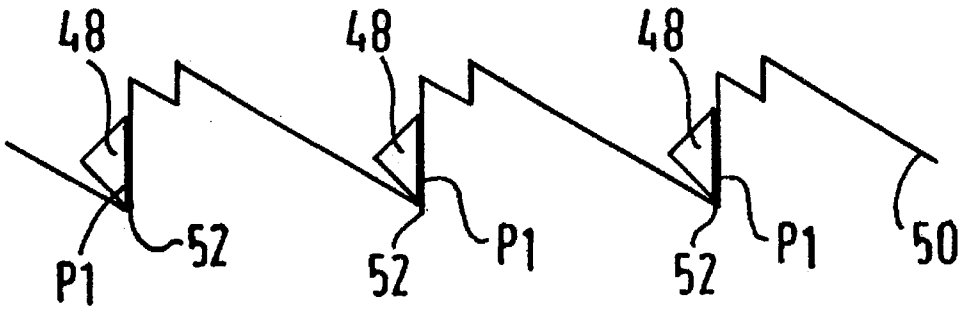
FIG. 3(*a*) is diagrammatic perspective view of internal components of the latching mechanism of FIGS. 2(*a*) to 2(*d*) showing an operating cam, a latching cam and a holding member, and FIG. 3(*b*) is a development of the cam surfaces shown in FIG. 3(*a*)
Figure 3A:
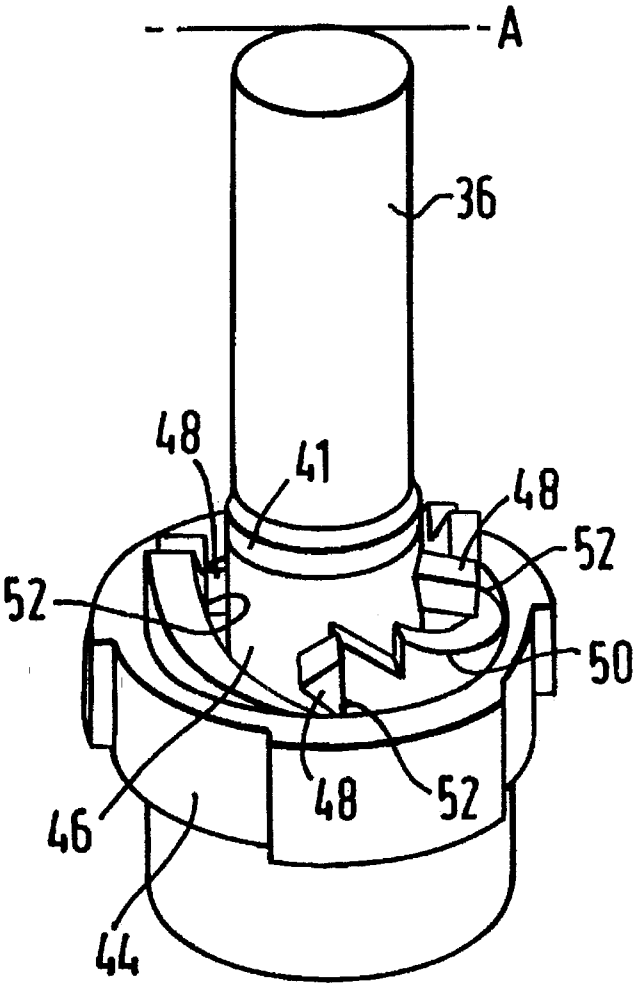

The above mentioned interactions will now be further described with reference to FIGS. 3 to 5. FIG. 3(*a*) is a diagrammatic perspective view showing the interrelationship between the latching cams (48) and the holding member (44) when the latching mechanism (24) is in the first stable state shown in FIG. 2(*a*). Latching cams (48) are defined by radial protrusions with a generally triangular cross section, positioned at equally spaced radial positions on the latching member (46). The holding member (44) is generally cylindrical with holding cam surface (50) formed on its outward end. The holding cam surface (50) includes a first set of troughs (52) spaced radially in a manner corresponding to the radial positions of the latching cams (48). FIG. 3(*b*) is a development of the cam surfaces shown in FIG. 3(*a*).

The latching cams (48) are located at positions P1 in the troughs (52) of the holding cam surface (50), where they are held by the thrust from button (34) as previously described, thus determining the fully retracted position A shown in FIG. 2(*a*).

Figure 4B:
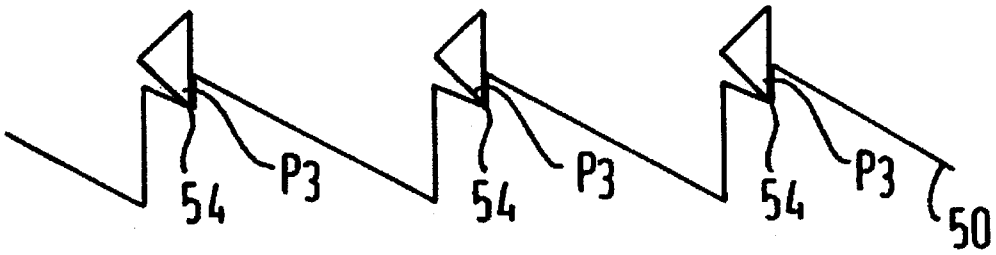
FIG. 4(*a*) is a diagrammatic perspective view of the internal components shown in FIG. 3(*a*) but in a different position, and FIG. 4(*b*) is a development of the same cam surface as in FIG. 3(*b*), but with the latching cam in a different position.
Figure 4A:
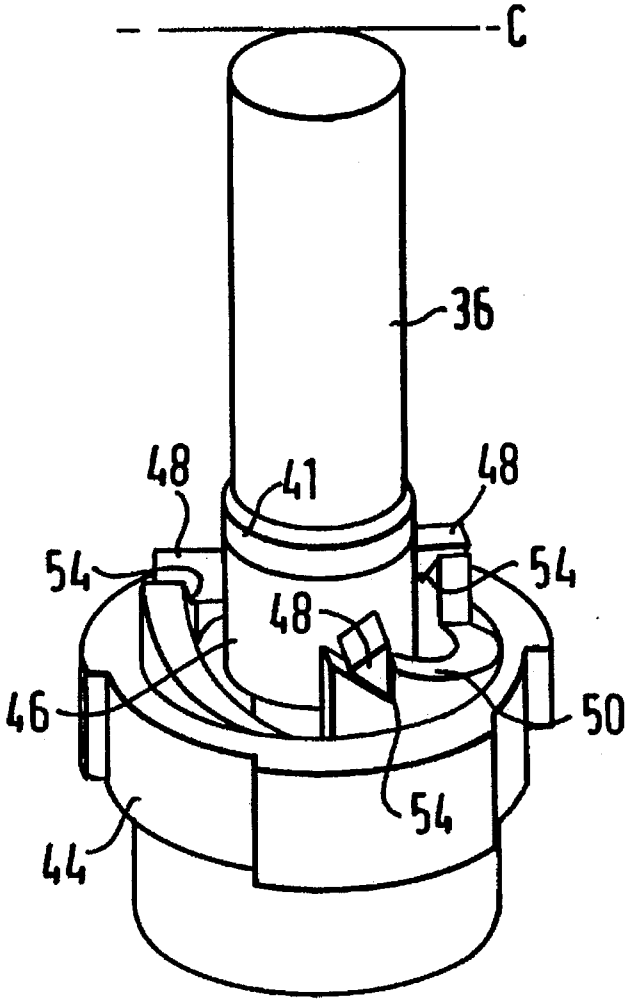

FIG. 4(*a*) is a diagrammatic perspective view showing the interrelationship between the latching cams (48) and the holding member (44) when the latching mechanism (24) is in the second stable state shown in FIG. 2(*c*). The holding cam surfaces (50) include a second set of troughs (54) spaced radially in a manner corresponding to the radial position of the latching cams (48) and spaced both radially and axially from the first set of troughs (52). FIG. 4(*b*) is a development of the cam surfaces shown in FIG. 4(*a*). The latching cams (48) are located at positions P3 in the troughs (54) of the holding cam surface (50). Thus the axial position of the second set of troughs (54) determines the position C of the actuating rod (36).

Figure 5A:
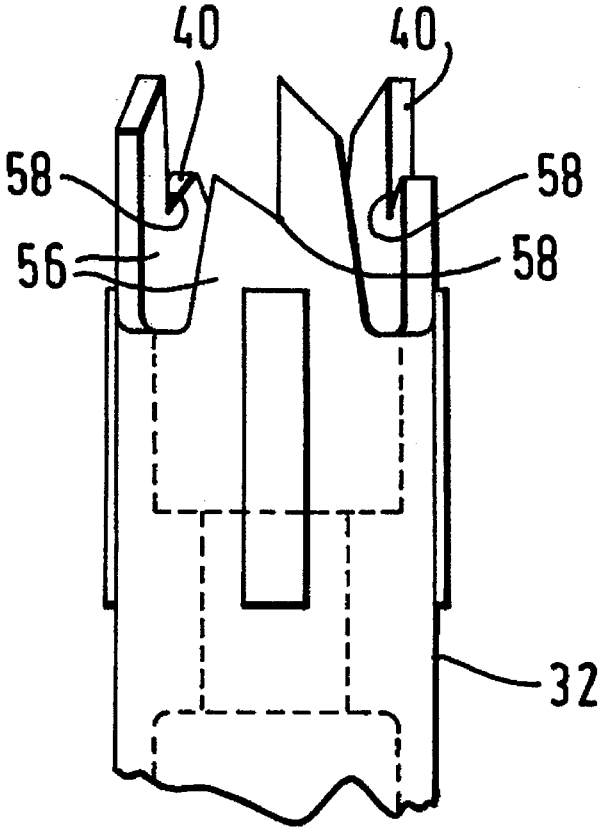
FIG. 5(*a*) is a side view of the inner end of an operating button forming part of the latching mechanism of FIGS. 2(*a*) to 2(*d*) and FIG. 5(*b*) is a development of an operating cam surface present at the end of the operating button and also shows parts of the latching cam.
Figure 5B:
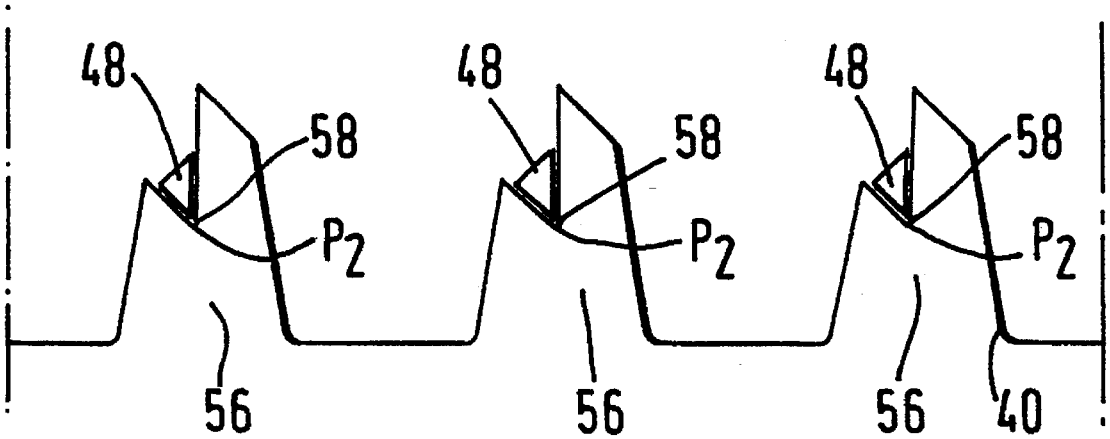

FIG. 5(*a*) is a side view of the inward end of the operating button (32) showing the operating cam surface (40). The operating button (32) has protrusions (56) which extend axially from its inward end and in which are formed troughs (58) in the operating cam surface (40) arranged in radial positions corresponding to the radial positions of the latching cams (48). FIG. 5(*b*) is a development of the operating cam surface (40) and shows the position P2 of the latching cams (48) when the operating button (32) is in its innermost position as shown in FIG. 2(*b*). The axial position of troughs (58) determines the position B of the actuating rod (36).

FIGS. 6(*a*) and 6(*b*) are respectively end views, looking inwardly from the direction X shown in FIG. 2(*a*), of the holding member (44), but showing only the innermost portion of the operating button (32) that appears in FIG. 5(*a*). The holding member (44) has on its outer surface a plurality of splines (60) which run in an axial direction and correspond to grooves on the inner surface of the body (38). The splines (60) and grooves prevent relative rotation of the holding member (44) and body (38). In addition, holding member (44) has a plurality of grooves (62) on its inner surface which run in an axial direction and correspond to splines (64) on the outer surface of the innermost portion of the operating button (32) and prevent relative rotation of the operating button (32) and the holding member (44) whilst allowing the operating button (32) to slide in axial directions within the holding member (44).

FIGS. 7(*a*) to 7(*d*) are developments of a part of the holding cam surface (50) and the operating cam surface (40), also showing one of the latching cams (48). They show in detail the inter-relationship of these parts in the various positions shown in FIGS. 2(*a*) to 2(*d*). FIG. 7(*a*) shows the operating cam surface (40) and the holding cam surface (50) in an axially movable but radially fixed and staggered relationship defined by the splines shown in FIGS. 6(*a*) and 6(*b*). In FIG. 7(*a*) the latching cam is shown in trough (52) of holding cam (50) which corresponds to position P1. Accordingly, the axial position A of the actuating rod (36) shown in FIG. 2(*a*) is determined by the axial position of troughs (52).

When the operating cam surface (40) is moved inwardly, the portion of the operating cam surface adjacent to the trough (58) moves into engagement with latching cam (48). Latching cam (48) is lifted axially out of the trough (52) and, when it is clear of trough (52) it rotates and moves axially to become fully engaged in the trough (58) of the operating cam surface (40) as shown in FIG. 7(*b*). The latching cam is now at position P2 in the first unstable state. Accordingly, the axial position B of the actuating rod (36) shown in FIG. 2(*b*) is determined by the axial position of trough (58).

When the operating cam surface (40) is moved in the opposite axial direction, it releases latching cam (48) from engagement with the trough (58), allowing the latching cam (48) to rotate and move axially to engage in trough (54). The latching cam (48) is now in position P3 in the second stable position as shown in FIG. 7(*c*). Accordingly, the axial position C of the actuating rod (36) shown in FIG. 2(*c*) is determined by the axial position of the trough (54).

When the operating cam surface (40) is moved, again, in an axial direction towards the latching cam (48) part (70) of the operating cam surface (40) engages with the latching cam (48) and moves it axially until it becomes clear of trough (54). The latching cam (48) then moves along surface (72), with a change in axial and rotational position, until it comes to rest in a position P4 between the surface (72) and the edge (74) forming part of the operating cam surface (40) to define the second unstable position. Accordingly, the axial position of the actuating rod (36) at position D shown in FIG. 2(*d*) is determined by the axial positions of the surfaces (72 and 74). If the operating cam surface (40) is again moved in the opposite axial direction then latching cam (48) is released from position P4 and resumes the position shown in FIG. 7(*a*).

FIGS. 8(*a*) to 8(*d*) are cross-sections of the latching mechanism (24) in further detail. The operating button (32) has five components, namely, a button portion (76) including an O-ring seal (78) for reducing the risk of contamination of the interior of the latching mechanism, a flange member (80) which holds the button portion (76) captive in the body member (38), and an operating cam surface member (82) which slidably fits into the flange member (80) and button portion (76). The operating cam surface member (82) is held captive by flange member (80) and is urged into the position shown in FIG. 8(*a*) by a spring (84). The body member (38) comprises two parts, a first part (86) and a second part (88) held in engagement by flanges (90) located on the second part which fit into sockets (92) on the first part. The actuating rod (36) comprises a cylindrical sleeve (94) and a rod (96) located within the sleeve (94) and held captive in it by small flanges at the bifurcated inner end of the rod (96). Rod (96) is movable both in rotation and axially within the sleeve (94) and its movement is against a spring (98) which urges the rod (96) into the extended position shown in FIG. 8(*a*). In applications of the latching mechanism (24), it may be possible that the actual movement of the actuating rod (36) is greater than the movement required to operate the electrical switch (22). In this situation the actuating rod (36) will tend to overtravel and, this over travel, is taken up by the retraction of rod (96) within the sleeve (94) against the action of the spring (98) as shown in FIG. 8(*b*).

Additionally, if the operating button (32) is subject to over travel as shown in FIG. 8(*c*), then this is taken up by the compression of the spring (84) as operating cam surface member (82) moves axially, retracting into the button portion (76). The provisions for over travel of the operating button (32) and the actuating rod (36) reduce the possibility of the latching cams (48), holding cam surface (50) and the operating cam surface (40) being damaged during operation.

FIG. 9 is an exploded view of the latching mechanism (24) showing its various parts. It will be noted that the first part (86) of the body member (38) is provided with two grooves (100). As shown in FIG. 10 these grooves 100 are used to locate a circlip or other fixing device to hold the latching mechanism (24) in place in a suitably sized aperture (104) in a bulkhead or wall (106). In addition, an O ring (106*a*) is provided to seal the latching mechanism (24) in the aperture (104). In this way, the latching mechanism (24) can be removed from and replaced within the aperture (104) by simply removing the circlip (102) and withdrawing the latching mechanism (24). Replacement is the reverse of removal.

FIGS. 11(*a*) to 11(*e*) show a development of the holding cam surface (50*a*), the operating cam surface (40*a*) and a latching cam (48*a*) according to a second embodiment of the latching mechanism. In this embodiment the holding cam surfaces (50*a*) are provided with a further set of troughs (108) in addition to troughs (52*a*) and (54*a*). Additionally, operating cam surface (40*a*) is provided with troughs (110) in addition to troughs (58*a*). It will be appreciated from the above description that the addition of troughs (108) and troughs (110) provides a third stable position when latching cam (48*a*) is engaged in trough (108) and a third unstable position when latching cam (48*a*) is engaged in trough (110). This has the effect of providing a latching mechanism which can operate a switch to three positions, for example, an OFF position when the latching cam (48*a*) is in its first stable position, a first ON position when the latching cam (48*a*) is in the second stable position and a second ON position when the latching cam (48*a*) is in the third stable position.

FIGS. 12(*a*) to 12(*c*) show the holding cam surface (50*b*), the operating cam surface (40*b*) and a latching cam (48) in a third form of the latching mechanism. In this embodiment, the holding cam surface (50*b*) has only a single set of troughs (52*a*). This arrangement provides only one stable position when latching cam (48*a*) is engaged with one of the troughs (52*a*) and two non-stable positions as shown in FIGS. 12(*b*) and 12(*c*). This arrangement can be used to provide a foot pedal which switches an electrical switch off when the pedal is raised (i.e. in the stable position), switches the electrical switch on when the pedal is half way depressed (i.e. in the first unstable position), and switches the electrical switch off either by depressing the pedal fully (i.e. to the second unstable position) or releasing the pedal from the half way position. The present embodiment may be modified by the addition of a second spring which acts on the operating button when it is in the halfway depressed position. This extra spring can provide a stop, detectable by the user, to indicate that the ON position has been reached.

FIGS. 13(*a*) to 13(*d*) show the holding cam surface (50*c*), the operating cam surface (40*c*), a latching cam (48*c*) and an upper cam surface (112) in a fourth form of the latching mechanism. The upper cam surface (112) is provided to assist the rotational movement of the latching cam (48*c*) when it is lifted out of engagement with trough (52*a*) as shown in FIG. 13(*b*). The addition of upper cam surface (112) reduces or eliminates the biassing force from the switch 22 (FIG. 1) required to bring about rotation of the latching member (46) and thereby permitting operation of the latching mechanism.

FIGS. 13(*c*) and 13(*d*) show the subsequent positions of the latching cam (48*c*).

Figures 14A, 14B, 14C, 14D, 14E:
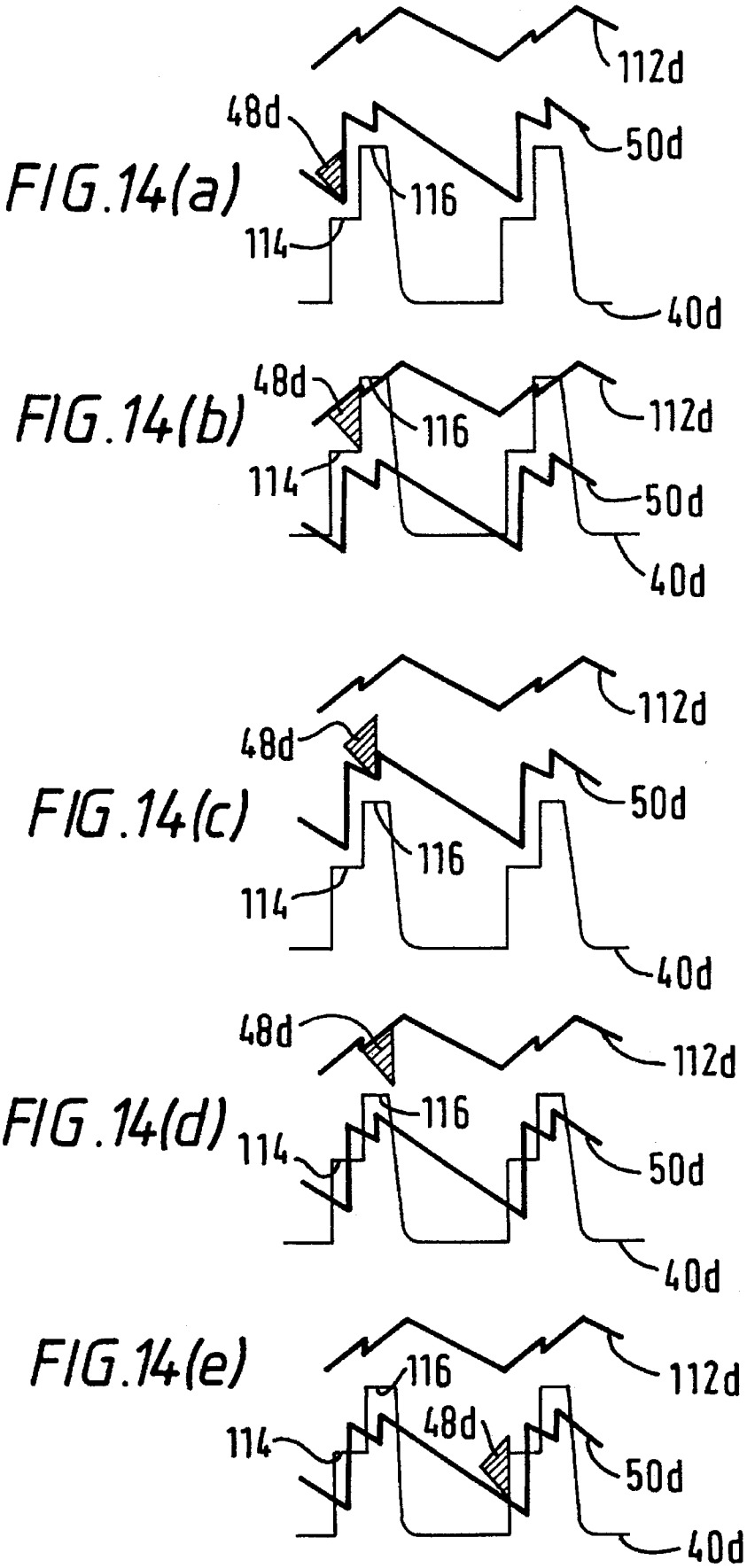

FIGS. 14(*a*) to 14(*e*) show the upper cam (112*d*), the holding cam (50*d*), the operating cam (40*d*) and a latching cam (48*d*) in a fifth embodiment of the latching mechanism in which the upper surfaces (114) and (116) of the operating cam surface (40*d*) cause no rotational movement of the latching cam (48*d*) when they engage as shown in FIG. 14(*d*). It is apparent from that figure that instead, the rotational movement is caused by the action of the latching cam (48*d*) against an upper cam surface (112*d*) as shown in FIGS. 14(*b*) and 14(*d*).

FIG. 15 shows a latching mechanism in a sixth embodiment in which the button (118) is covered with a diaphragm (120) the periphery of which sealingly engages between a collar (122) of body member (124) on the one hand and a cover member (126) on the other hand. The cover member (126) and the collar (122) have complementary snap engaging formations (128) and (130) to hold the cover member (126) in place. The cover member (126) also has an integral nipple (132) for the connection of a hydraulic or air supply. When fluid is supplied under pressure through nipple (132) the diaphragm (120) is pushed inwardly into contact with the button (118) to operate the latching mechanism. If the pressure is released then the button (118) and the diaphragm (120) will return to their positions as shown in FIG. 15. In this way, the latching mechanism of the present invention can be operated hydraulically or pneumatically, pneumatic operation e.g. by compressed air being commonplace in many systems of this kind.

It will also be appreciated by those skilled in the art that the latching mechanism shown in FIG. 15 could be modified to remove the mechanisms which compensate for overtravel as described above, in air operated embodiments.

FIG. 16 shows a latching mechanism 24(*e*) according to a seventh embodiment of the invention in which the second part (88*e*) of the body member (38*e*) has been modified so that it is slidably mounted relative to the first part (86*e*) of the body member (38*e*) and held captive therein by flange (131). Second part (88*e*) has upper cam surfaces (112*e*) formed on its inner surface and pushes at its outward end against flange (134) on actuating rod (36*e*).

FIGS. 17(*a*) to 17(*e*) are developments of the operating cam surface (40*e*), holding cam surface (50*e*), upper cam surface (112*e*) and a latching cam (48*e*) of the embodiments shown in FIG. 16. FIG. 17(*a*) shows a nominal start position. FIG. 17(*b*) shows the operating cam (40*e*) having moved into engagement with the latching cam (48*e*) which in turn engages the upper cam surface (112*e*) moving the first part (88*e*) in an axial direction. The axial movement of part 88(*e*) is transmitted via flange (134) to move actuating member (36*e*) outwardly. FIG. 17(*c*) shows the latching cam (48*e*) holding the upper cam surface (112*e*) in the second stable state for this embodiment (as opposed to the first stable state shown in FIG. 17(*a*)). FIG. 17(*d*) shows the operating cam (40*e*) engaging with the latching cam (48*e*) to push the operating cam (48*e*) into engagement with the upper cam surface (112*e*) to move it to its furthest outwardly extended position, after which, it moves inwardly as the latching cam (48*e*) moves to the position shown in FIG. 17(*e*).

FIGS. 18(*a*) to 18(*e*) show developments of the cam surfaces in an eighth embodiment of the present invention. In this embodiment the holding cam surface (50*f*) is provided with two sets of relatively shallow troughs (136) and (138). FIG. 18(*a*) shows the nominal rest position and FIG. 18(*b*) shows the operating cam surface (40*f*) in engagement with the latching cam (48*f*) and holding it in the first unstable position wherein, for example, the electrical switch is in the ON position. FIG. 18(*c*) shows the latching cam (48*f*) having moved into engagement with the trough (138) after having been pushed out of the position shown in FIG. 18(*b*) above by the further axial movement of the operating cam surface (40*f*). FIG. 18(*d*) shows the subsequent retraction of the operating cam surface (40*f*) and the movement of a reset cam surface (140) into engagement with the upper surface of the latching cam (48*f*) and urging it out of engagement with the trough (138). As shown in FIG. 18(*e*) the latching cam (48*f*)

is urged into engagement with trough (136) i.e. back into the nominal start position shown in FIG. 18(*a*). The reset cam may be operated by a separate button from the operating cam thereby providing extra control of the switch being operated. When the latching cam (48*f*) is in the position shown in FIG. 18(*c*) the operating cam (48*f*) is not able to engage with it to move it to the position shown in FIG. 18(*b*) where the switch being controlled is in the ON position. It is not until the reset cam surface (140) has been operated as shown in FIGS. 18(*d*) and 18(*e*) that the button actuating the operating cam surface (40*f*) will function to switch the switch being controlled to the ON position.

It will be understood from the above description that the reset mechanism described above with reference to FIGS. 18(*a*) to 18(*e*) is equally applicable to each of the previously described embodiments.

Although the latching mechanism of the present invention has been described as being operated by pneumatic, hydraulic or mechanical means it will also be clear to those skilled in the art that it could be operated by electromechanical means such as a solenoid or by hand. Additionally, although the latching mechanism of the present invention has only been described as operating on an electrical switch it will also be clear to those skilled in the art that the latching mechanism could be used to operate many types of switches or valves for controlling the flow of fluid including those which are mechanical, hydraulic, pneumatic, electrical or optical.

It will be appreciated from the above description that embodiments of the present invention can be further modified. For example, a spring could be installed between the body member (38) and the flange (41) to provide a biassing force to retract the actuating rod (36), thereby reducing or removing the need to provide an electrical or other switch with a bias button. Also, it will be appreciated by those skilled in the art that more than one switch of an electrical or other type or combination of types could be actuated by the latching mechanism of the present invention and, that the present invention is not restricted to holding the switch in an ON position when it is extended and OFF when it is retracted but, for example, could reverse this action.

It will also be appreciated by those skilled in the art that the invention may also be embodied in latching mechanisms whose cam surfaces are not identical in shape to those described above and shown in the figures. For example the latching cams could be substantially ovoid, circular, square or oblong in cross-section with the troughs or other parts of the cam surfaces being of corresponding shapes. In addition, it will appreciated that the invention is not restricted to having sets of three latching cams (48) and their corresponding cam surfaces with troughs but may have one latching cam in combination with a plurality of other cam surfaces with troughs or two or more latching cams in combination with corresponding other cam surfaces and troughs. The embodiments of the present invention could also be modified to provide a holding cam surface which is free to rotate radially and a latching member which is splined to the actuating rod so that it cannot rotate, thereby transferring the rotary motion to the holding cam surface instead of the latching member.

I claim:

1. An actuator mechanism for converting an input movement to a control movement for moving a controlled device, said mechanism comprising:

a housing;

first and second elements in said housing;

means in said housing supporting said first and second elements for movement along a line of action, the first element being movable in translation along the line of action in a forward direction from a normal position in response to the input movement, and the second element being movable in translation along the same line of action to provide the control movement;

resilient means biasing the first element in a return direction to its normal position;

a latching member rotatably supported on the second element and having latching cams facing in the return direction;

means in said housing providing a holding cam surface facing in the forward direction for engagement by the latching member to hold said first and second elements in a first relative axial position at a greater spacing apart along the line of action at first rotational positions of the latching member and to hold said elements at a second relative axial position at a lesser spacing along the line of action at second rotational positions of the latching member; and means carried by the first element defining an operating cam surface facing in the forward direction for moving the latching member cyclically between its first and second rotational positions, the latching member and the holding and operating cam surfaces being arranged so that movement of the elements to the first relative axial position is enabled by said one movement of the first element from its normal position without requiring return of the first element to its normal position and so that release of the elements from their first relative axial position for movement to their second relative axial position is enabled by a succeeding forward movement of the first element without requiring return of the first element to its normal position.

2. An actuator mechanism according to claim 1, wherein the succeeding movement is a second movement of the first element following return of the first element to its normal position.

3. The mechanism of claim 2, wherein the latch means operates to hold the elements in at least one intermediate position at a spacing apart between that at the first relative position and that at the second relative position on at least one additional movement of the first element from its normal position.

4. The mechanism of claim 3 wherein there is a single intermediate position and the cycle comprises three successive movements of the first element from its normal position.

5. The mechanism of claim 3, wherein there are more than one intermediate positions and the cycle comprises four or more successive movements of the first element from its normal position.

6. The mechanism of claim 1, herein the succeeding movement is a further movement of the first element from its normal position during a single travel from said normal position, the first part of said travel corresponding to the greater spacing apart of the first and second elements, and the second part of said travel permitting said elements to return to their lesser spacing.

7. A mechanism according to claim 1, wherein said latching member has an axis of rotation parallel to the line of action of the first and second elements.

8. A mechanism according to claim 7 further comprising cam means arranged to cooperate with the rotary latch means on movement of the first element from its normal position to assist rotation of the latch means.

9. An actuator mechanism for converting an input movement to a control movement for moving a controlled device, said mechanism comprising:

first and second elements, means supporting said first and second elements for movement along a line of action, the first element being movable in translation along the line of action from a normal position in response to the input movement and being biased to return to said normal position and the second element being movable in translation along the same line of action to provide the control movement, wherein latch means operates cyclically to hold the elements in a first relative axial position at a greater spacing apart along the line of action after one movement of the first element from its normal position and to release the elements for movement to a second relative axial position at a lesser spacing along the line of action after a succeeding movement of the first element from its normal position, wherein release of the elements for movement to the second relative axial position is enabled by the succeeding forward movement of the first element without requiring return of the first element to its normal position, the second element comprising first and second members which are relatively movable along the line of action through a predetermined travel to accommodate over travel of the second element relative to the controlled device.

10. A mechanism according to claim 9, wherein means resiliently biases the first and second members apart.

11. A mechanism according to claim 1, wherein the first element is movable along the line of action through a predetermined distance against the action of said resilient means, said mechanism being arranged to operate only when the first element has travelled a distance greater than said predetermined distance.

12. In combination, an actuator mechanism as defined in claim 1 and a controlled device having an input member whose line of action is coincident with the line of action of the actuator mechanism.

13. The combination of claim 12, wherein the controlled device is an electrical switch.

14. The combination of claim 12, wherein the controlled device is a valve for controlling the flow of fluid.

15. The combination of claim 12, wherein the first element is a manually operated button.

16. The combination of claim 12, wherein the first element is operated by a lever.

17. The combination of claim 16, wherein the lever is defined by a hinged pedal having a formation that bears on the first element.

18. The combination of claim 12, wherein the first element is contained in a chamber and is arranged to be operated on supply of fluid to the chamber.

19. The combination of claim 18, wherein the fluid is air.

* * * * *